US011925284B2

(12) United States Patent
Tokura

(10) Patent No.: US 11,925,284 B2
(45) Date of Patent: Mar. 12, 2024

(54) CHOPSTICKS HOLDER STRUCTURE

(71) Applicant: LANAN INTERNATIONAL CO., LTD., New Taipei (TW)

(72) Inventor: Tsunenobu Tokura, Kawanishi (JP)

(73) Assignee: LANAN INTERNATIONAL CO., LTD., New Taipei (TW)

( * ) Notice: Subject to any disclaimer, the term of this patent is extended or adjusted under 35 U.S.C. 154(b) by 154 days.

(21) Appl. No.: 17/685,405

(22) Filed: Mar. 3, 2022

(65) Prior Publication Data

US 2022/0338654 A1 Oct. 27, 2022

(30) Foreign Application Priority Data

Apr. 22, 2021 (TW) ..... 110204462

(51) Int. Cl.
*A47G 21/06* (2006.01)
*A47G 21/14* (2006.01)

(52) U.S. Cl.
CPC ..... *A47G 21/103* (2013.01); *A47G 21/14* (2013.01)

(58) Field of Classification Search
CPC ..... A47G 21/103; A47G 21/14
USPC ..... 248/37.3
See application file for complete search history.

(56) References Cited

U.S. PATENT DOCUMENTS

| | | | | |
|---|---|---|---|---|
| D378,564 | S * | 3/1997 | Hall | D7/637 |
| D447,013 | S * | 8/2001 | Joergensen | D7/637 |
| D497,781 | S * | 11/2004 | Joseph | D7/586 |
| 2011/0114533 | A1* | 5/2011 | Le | A47G 21/14 206/553 |
| 2020/0214483 | A1* | 7/2020 | Clark | A47G 21/14 |

* cited by examiner

*Primary Examiner* — Bradley Duckworth

(57) ABSTRACT

A chopsticks holder structure includes a chopsticks holder body, a placement portion and a pick-up portion. The chopsticks holder body includes a top portion and a bottom portion. The placement portion is laterally arranged at the top portion of the chopsticks holder body. The pick-up portion is longitudinally arranged at the top portion of the chopsticks holder body and is in communication with the placement portion, and a height of the pick-up portion is lower than that of the placement portion. Thus, the overall size of the chopsticks holder structure can be reduced, the chopsticks are placed at the placement portion during use, and the design that the height of the pick-up portion is lower than that of the placement portion allows fingers to easily pick up the chopsticks for use from the pick-up portion, achieving convenience for use.

2 Claims, 3 Drawing Sheets

CHOPSTICKS HOLDER STRUCTURE

CROSS-REFERENCE TO RELATED APPLICATION

This non-provisional application claims priority under 35 U.S.C. § 119(a) on Patent Application No(s). 110204462 filed in Taiwan, R.O.C. on Apr. 22, 2021, the entire contents of which are hereby incorporated by reference.

BACKGROUND OF THE INVENTION

1. Field of the Invention

The present disclosure relates to a chopsticks holder structure, and in particular to a chopsticks holder structure capable of reducing an overall size of the chopstick holder structure and allowing fingers to easily pick up chopsticks, achieving convenience for use.

2. Description of the Related Art

The term "ear cup" generally implies to a chopsticks holder exclusive for a pair of chopsticks (chopsticks shaped long and slender on both ends) commonly used for food consumption by gods and humans. As the length of the shrine chopsticks for delicacy of the gods is longer than the ordinary one for daily life, the size of a corresponding chopsticks holder is also larger. If an "ear cup" for delicacies of the gods is directly used for "Washoku" of common cuisine, an issue of inappropriate size and proportion can be resulted. For example, since a chopsticks holder is larger and deeper while chopsticks are shorter, the chopsticks may sink into the chopsticks holder once placed thereon, or a table layout may be appear inharmonious caused by such large chopsticks holder, incurring inconvenience in picking up of the chopsticks and unsuitability in terms of size.

BRIEF SUMMARY OF THE INVENTION

In view of the above, on the basis of extensive development with the practice of theories, the inventor has provided a chopsticks holder structure in aim of reducing the overall size of the chopsticks holder and allowing fingers to easily pick up chopsticks for use, thereby achieving the objects of providing convenience and suitability for consumption of common delicacies.

To achieve the above and other objects, the present disclosure provides a chopsticks holder structure including a chopsticks holder body, a placement portion and a pick-up portion. The chopsticks holder body has a top portion and a bottom portion. The placement portion is laterally arranged at the top portion of the chopsticks holder body. The pick-up portion is longitudinally arranged at the top portion of the chopsticks holder body and is in communication with the placement portion, and a height of the pick-up portion is lower than that of the placement portion.

In the chopsticks holder structure above, the chopsticks holder body has a hollow shape.

In the chopsticks holder structure above, the placement portion has a first recess and a second recess. The first recess and the second recess correspond to each other, and the first recess and the second recess are located on two ends of the top portion of the chopsticks holder body, respectively.

In the chopsticks holder structure above, the pick-up portion has a third recess and a fourth recess. The third recess and the fourth recess correspond to each other, and the third recess and the fourth recess are located on two sides of the top portion of the chopsticks holder body, respectively.

In the chopsticks holder structure above, heights of the third recess and the fourth recess are lower than those of the first recess and the second recess.

Accordingly, the chopsticks holder structure of the present disclosure can reduce the overall size of the chopsticks holder structure, the chopsticks are placed at the placement portion during use, and the design that the height of the pick-up portion is lower than that of the placement portion allows fingers to easily pick up the chopsticks for use from the pick-up portion, achieving the object of providing convenience for use.

DETAILED DESCRIPTION OF THE INVENTION

To facilitate understanding of the object, characteristics and effects of this present disclosure, embodiments together with the attached drawings for the detailed description of the present disclosure are provided.

Figure 1:
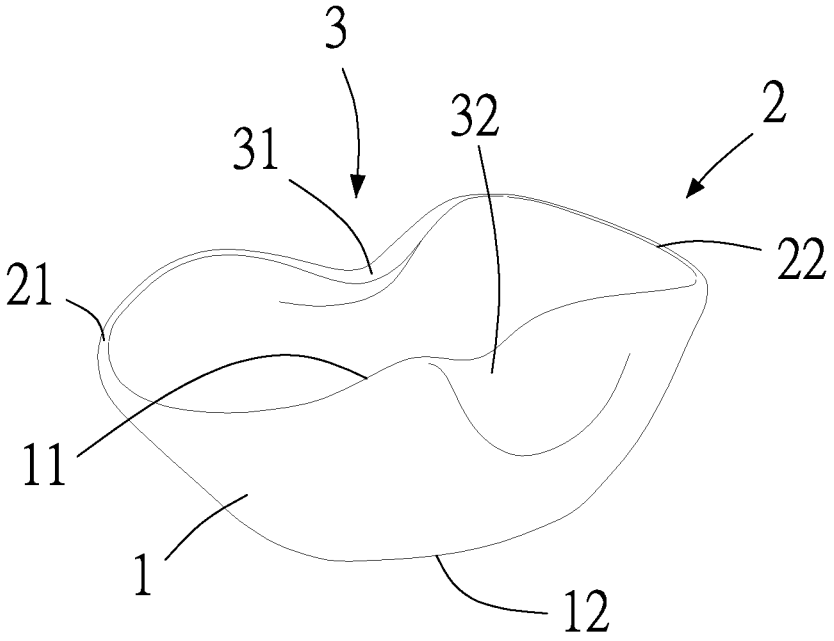
FIG. 1 is a schematic diagram of an appearance of a chopsticks holder structure of the present disclosure.
Figure 2:
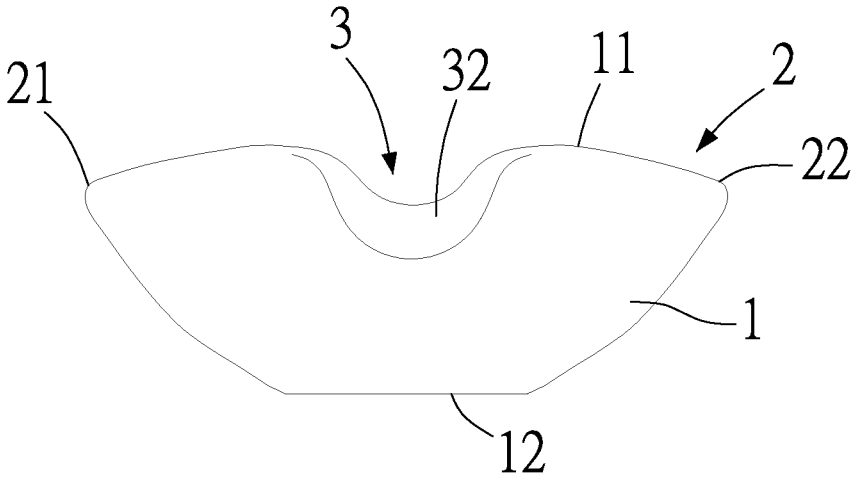
FIG. 2 is a side schematic diagram of a chopsticks holder structure of the present disclosure.
Figure 3:
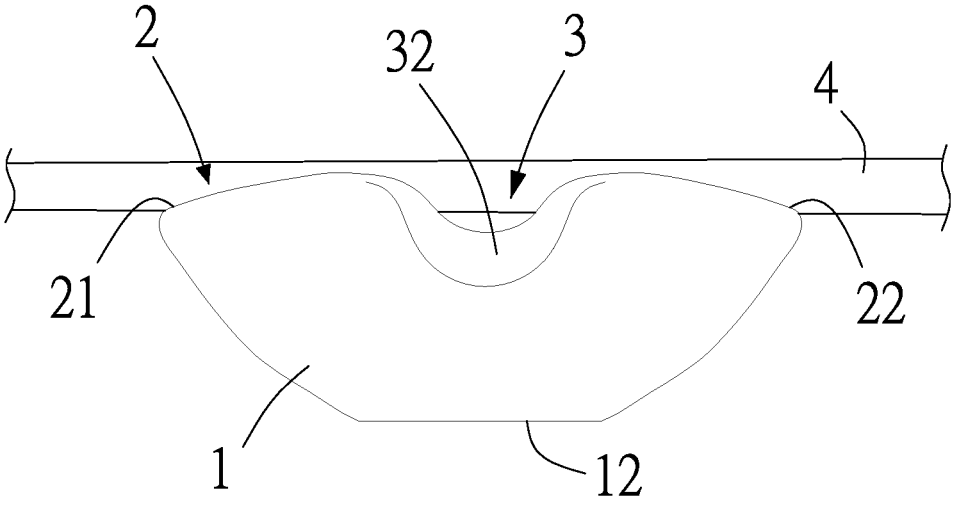
FIG. 3 is a first schematic diagram of use of a chopsticks holder structure of the present disclosure.
Figure 4:
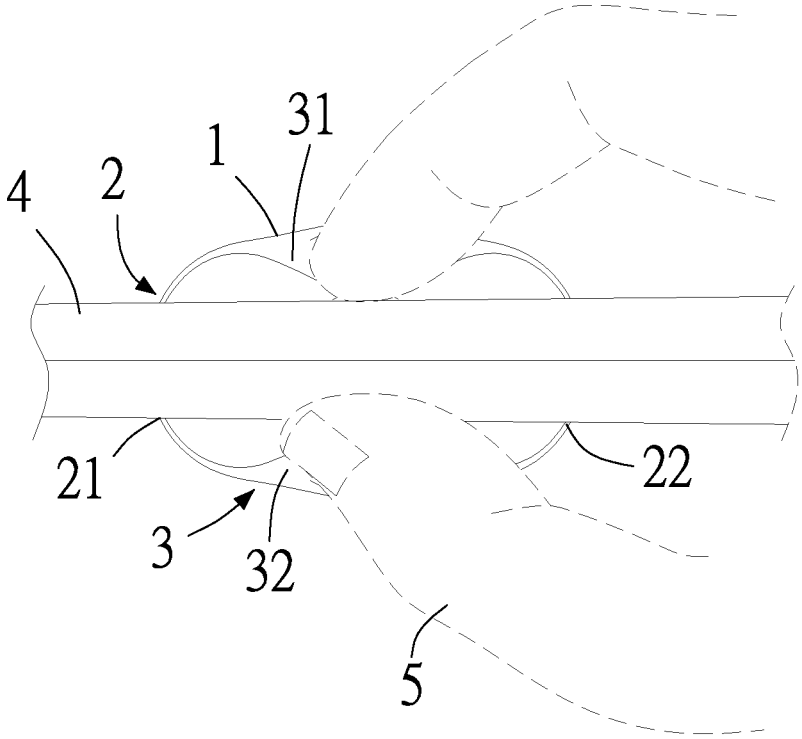
FIG. 4 is a second schematic diagram of use of a chopsticks holder structure of the present disclosure.

Referring to FIG. 1 to FIG. 4, as shown in the drawings, a chopsticks holder structure of the present disclosure includes a chopsticks holder body 1, a placement portion 2 and a pick-up portion 3.

The chopsticks holder body 1 includes a top portion 11 and a bottom portion 12.

The placement portion 2 is laterally arranged at the top portion 11 of the chopsticks holder body 1.

The pick-up portion 3 is longitudinally arranged at the top portion 11 of the chopsticks holder body 1 and is in communication with the placement portion 2, and the height of the placement portion 3 is lower than that of the placement portion 2.

With the arrangement of the chopsticks holder body 1, the placement portion 2 and the pick-up portion 3 above, the effect of reducing the overall size of the chopsticks holder structure can be achieved.

To use the chopsticks holder structure of the present disclosure, the chopsticks holder body 1 may be placed in a manner of the bottom portion 12 being on a table surface, chopsticks 4 are placed on the placement portion 2, and the pick-up portion 3 correspond to a side portion of the chopsticks 4, so that the chopsticks 4 are temporarily placed (that is, a non-permanent arrangement means) at the top portion 11 of the chopsticks holder body 1 in a lateral arrangement via the placement portion 2. To pick up the chopsticks 4 for use, a force is applied by fingers 5 on the side portions of the chopsticks 4 via the pick-up portion 3, so as to pick up the chopsticks 4 for use. Since the height of the pick-up portion 3 is lower than that of the placement portion 2, the fingers 5 are provided with a better force application space to allow the fingers 5 to easily pick up the chopsticks 4 from the pick-up portion 3, further achieving suitability and convenience for consumption of common delicacies.

In one embodiment of the present disclosure, the chopsticks holder body 1 is a hollow shape, and the bottom portion 12 of the chopsticks holder body 1 is a flat shape. Thus, the chopsticks holder body 1 may yield a more esthetically appealing look, while the chopsticks holder body 1 is enabled to be steadily placed on the table surface via the bottom portion 12.

Moreover, the chopsticks holder body 1 may also be solid or have other appearance designs according to requirements, so as to satisfy effects of esthetically appealing during practical use, and at the same time achieving the effect of reducing the overall size of the chopsticks holder structure.

In one embodiment of the present disclosure, the placement portion 2 has a first recess 21 and a second recess 22. The first recess 21 and the second recess 22 correspond to each other, and the first recess 21 and the second recess 22 are located on two ends of the top portion 11 of the chopsticks holder body 1, respectively. The pick-up portion 3 has a third recess 31 and a fourth recess 32. The third recess 31 and the fourth recess 32 correspond to each other, and the third recess 31 and the fourth recess 32 are located on two sides of the top portion 11 of the chopsticks holder body 1, respectively. Moreover, the third recess 31 and the fourth recess 32 are respectively concaved downward from the top portion 11 of the chopsticks holder body 1 and concaved inward from two outer surfaces of the chopsticks holder body 1. Furthermore, the heights of the third recess 31 and the fourth recess 32 are lower than those of the first recess 21 and the second recess 22, and a horizontal distance between the third recess 31 and the fourth recess 32 is smaller than that between the first recess 21 and the second recess 22.

Thus, the chopsticks 4 can be placed at the placement portion 2, and the chopsticks 4 are then received by the first recess 21 and the second recess 22. Moreover, the two side portions of the chopsticks 4 are corresponded to the third recess 31 and the fourth recess 32 of the pick-up portion 3, so that the chopsticks 4 are temporarily placed at the top portion 11 of the chopsticks holder body 1 in a lateral arrangement via the placement portion 2. To pick up the chopsticks 4 for use, a force is applied by the fingers 5 to the two side portions of the chopsticks 4 via the third recess 31 and the fourth recess 32 of the pick-up portion 3 to pick up the chopsticks 4 for use. Since the heights of the third recess 31 and the fourth recess 32 of the pick-up portion 3 are lower than those of the first recess 21 and the second recess 22 of the placement portion 2, and the third recess 31 and the fourth recess 32 are concaved inwardly, the fingers 5 are provided with a better force application space via the third recess 31 and the fourth recess 32, allowing the fingers 5 to easily pick up the chopsticks 4 from the pick-up portion 3, further achieving suitability and convenience for consumption of common delicacies.

While the present disclosure has been described by means of specific embodiments, numerous modifications and variations could be made thereto by those skilled in the art without departing from the scope and spirit of the present disclosure set forth in the claims.

What is claimed is:

1. A chopsticks holder structure, comprising:

a chopsticks holder body, comprising a top portion and a bottom portion;

a placement portion, laterally arranged at the top portion of the chopsticks holder body, the placement portion has a first recess and a second recess for placing chopsticks, the first recess and the second recess correspond to each other, and the first recess and the second recess are located on two ends of the top portion of the chopsticks holder body, respectively; and a pick-up portion, longitudinally arranged at the top portion of the chopsticks holder body and being in communication with the placement portion, the pick-up portion has a third recess and a fourth recess for picking up chopsticks, the third recess and the fourth recess corresponding to each other, and the third recess and the fourth recess are located on two sides of the top portion of chopsticks holder body, respectively; the third recess and the fourth recess are respectively concaved downward from the top portion of the chopsticks holder body and concaved inward from two outer surfaces of the chopsticks holder body; heights of the third recess and the fourth recess are lower than those of the first recess and the second recess, and a horizontal distance between the third recess and the fourth recess is smaller than that between the first recess and the second recess.

2. The chopsticks holder structure according to claim 1, wherein the chopsticks holder body is a hollow shape.

* * * * *